US012369619B2

(12) United States Patent
Hui

(10) Patent No.: US 12,369,619 B2
(45) Date of Patent: Jul. 29, 2025

(54) HEAT-NOT-BURN AEROSOL-GENERATING ARTICLE, PRODUCT AND MANUFACTURING METHOD THEREOF

(71) Applicant: CCOBATO (SHENZHEN) TECHNOLOGY LTD, Shenzhen (CN)

(72) Inventor: Chi Hung Hui, Shenzhen (CN)

(73) Assignee: CCOBATO (SHENZHEN) TECHNOLOGY LTD, Shenzhen (CN)

( * ) Notice: Subject to any disclaimer, the term of this patent is extended or adjusted under 35 U.S.C. 154(b) by 642 days.

(21) Appl. No.: 17/794,451

(22) PCT Filed: Mar. 31, 2020

(86) PCT No.: PCT/CN2020/082510
§ 371 (c)(1),
(2) Date: Jul. 21, 2022

(87) PCT Pub. No.: WO2021/068464
PCT Pub. Date: Apr. 15, 2021

(65) Prior Publication Data

US 2023/0049209 A1 Feb. 16, 2023

(30) Foreign Application Priority Data

Oct. 11, 2019 (CN) ..... 201910965220.0

(51) Int. Cl.
*A24D 1/20* (2020.01)
*A24B 15/28* (2006.01)
*A24C 5/01* (2020.01)

(52) U.S. Cl.
CPC ..... *A24C 5/01* (2020.01); *A24B 15/287* (2013.01)

(58) Field of Classification Search
CPC ..... A24D 1/20; A24B 3/14
See application file for complete search history.

(56) References Cited

U.S. PATENT DOCUMENTS 4,694,842 A * 9/1987 Kobayashi ..... A24B 15/30 131/359
4,821,749 A * 4/1989 Toft ..... A24B 3/14 131/297
5,240,016 A * 8/1993 Nichols ..... A24B 15/165 131/194

* cited by examiner

*Primary Examiner* — Eric Yaary
(74) *Attorney, Agent, or Firm* — WPAT, PC

(57) ABSTRACT

The present disclosure relates to a heat-not-burn (HNB) aerosol-generating article, which comprises aerosol-generating raw material, aerosol-generating agent, and water. The aerosol-generating raw material is pre-pulverized and then sieved through a 40-200 mesh sieve. The aerosol-generating raw material, the aerosol-generating agent, and water are mixed in a certain proportion and blended into paste, so that the HNB aerosol-generating article is in a shape of paste stick when extruded, and is used to be injected into the HNB cartridge tube by extrusion into the paste stick. The paste stick HNB aerosol-generating article has internal pores in a form of loose paste stick. When the user performs a suction action, the pores are convenient for the aerosol passing through the paste stick HNB aerosol-generating article into the human mouth smoothly. The above-mentioned HNB aerosol-generating article is suitable for HNB non-tobacco products or HNB tobacco products and the like.

9 Claims, 3 Drawing Sheets

100

1

HEAT-NOT-BURN AEROSOL-GENERATING ARTICLE, PRODUCT AND MANUFACTURING METHOD THEREOF

BACKGROUND

Technical Field

The present disclosure relates to a field of heat-not-burn non-tobacco and tobacco products, and more particularly to a heat-not-burn aerosol-generating article, product and manufacturing method thereof.

Related Art

At present, the current trend is for new type non-tobacco and tobacco products such as heat-not-burn (HNB), but an aerosol-generating article production process of HNB non-tobacco products and tobacco products on the market is complex, and the use of more tobacco production devices cost a certain amount of manpower and financial resources. And most aerosol-generating articles adopt filament, flake, or other shapes such as granular. When the heater is used for heating and suction, the suction resistance is too large, and an amount of smoke is too small, which affects the suction effect.

Existing aerosol-generating articles are usually in the shape of filaments, flakes, or granules. When filling them into a smoke tube, manual filling is usually required, which is inconvenient to operate and an amount of filling is not easy to control. Even if it is converted to mechanized operation, it will be more difficult to control a filling operation, the automatic machinery will be very complicated, the filling operation will be difficult to control, and a filling amount will be difficult to achieve consistent.

SUMMARY

In view of this, it is necessary to provide a heat-not-burn (HNB) aerosol-generating article, product and manufacturing method thereof, which are easy to operate to fill into smoke tube and have a good suction effect.

An HNB aerosol-generating article is used to be loaded into a tube of a HNB non-tobacco or tobacco product, which includes aerosol-generating raw material, aerosol-generating agent, and water. Wherein the aerosol-generating raw material is pre-pulverized and then sieved, a mass percentage of the water is 30%-60%, the aerosol-generating raw material, the aerosol-generating agent, and the water are mixed and blended into paste, so that the HNB aerosol-generating article is in a shape of paste stick when extruded, and is used to be injected into an HNB cartridge tube by extrusion into the paste stick. Preferably, the HNB aerosol-generating article is composed of following parts by weight: 40-80 parts of the aerosol-generating raw material, 30-60 parts of the aerosol-generating agent, and 30-50 parts of the water.

Preferably, the aerosol-generating agent is 30-60 parts of glycerol, and the aerosol-generating raw material is pre-pulverized and then sieved through a 40-200 mesh sieve.

Preferably, the aerosol-generating raw material is a combination of one or more of herbal spice or Chinese medicine raw material, the herbal spice is preferably a combination of one or more of tea, lotus leaf, mint, licorice, clove, dried lemon, dried orange, chrysanthemum, star anise, osmanthus, mulberry leaf, bay leaf, perilla, orange, angelica dahurica, amomum tsao-ko, tangerine peel, gynostemma pentaphyllum, lavender, hawthorn, rose, honeysuckle, tartary buckwheat tea, chestnut, ilibiscus, lily, lysimachia foenum-graecum hance, spikenard, abrus cantoniensis, banksia rose, sandalwood, agarwood, coffee, blueberry, and strawberry, the Chinese medicine raw material can be a combination of one or more of radix rehmanniae, prepared rehmannia root, angelica sinensis, cassia seed, dandelion, apocynum venetum, jujube, medlar, fritillaria cirrhosa, panax notoginseng, sterculia scaphigera, borneol, menthol, saffron, poria, pueraria, dalbergia odorifera, holy basil, perilla leaves, bupleurum, isatis root, astragalus, prunella vulgaris, ginseng, white peony, gastrodia elata, and schisandra chinensis, and the aerosol-generating raw material is made by grinding into powder and mixing.

Preferably, the paste stick HNB aerosol-generating article is a density of 0.5 g-1.5 g/ml and a dynamic viscosity of 150-500 Pa.s, the paste stick HNB aerosol-generating article having internal pores to allow aerosol to penetrate and exude, a porosity thereof is 40-75%, and the paste stick HNB aerosol-generating article having internal pores is preferably a columnar paste, which automatically forms a loose columnar body after being heated.

Preferably, the paste stick HNB aerosol-generating article is dried to remove moisture after being injected into an HNB cartridge tube, a moisture content is reduced to 5-10% by mass, and the paste stick HNB aerosol-generating article is injected into the HNB cartridge tube by means of pneumatic, hydraulic, or mechanical screw drive injection.

The present invention also provides a tobacco aerosol-generating article which includes the HNB aerosol-generating article as described above, the aerosol-generating raw material includes tobacco raw material or tobacco extract, and the aerosol-generating raw material can be independently composed of tobacco raw material or tobacco extract, the aerosol-generating raw material can also be made from the tobacco raw material or the tobacco extract mixed with a combination of one or more of herbal spice and Chinese medicine raw material, when mixed with the herbal spice or the Chinese medicine raw material, the tobacco raw material is ground into powder first, and then the tobacco raw material powder is mixed into the herbal spice or Chinese medicine raw material and ground into powder and mixed together. Another aspect of the present invention provides a tobacco product, which includes a HNB cartridge tube and an aerosol-generating article loaded into the cartridge tube, the aerosol-generating article including the aforementioned tobacco aerosol-generating article.

Moreover, an HNB non-tobacco product includes an HNB cartridge tube and an aerosol-generating article loaded into the tube, and the aerosol-generating article includes the HNB non-tobacco aerosol-generating article as described above.

The present invention also provides a manufacturing method of an HNB aerosol-generating article, including the following steps: pulverizing the aerosol-generating raw material, wherein a pulverized particle size is 40-200 mesh; mixing the aerosol-generating raw material and the aerosol-generating agent according to a proportion, and adding a predetermined amount of water to make the mixture into the paste.

In the above-mentioned HNB aerosol-generating article and its manufacturing method and products, the formula of aerosol-generating raw material, aerosol-generating agent, and water is used, and the HNB aerosol-generating article is made into paste and mud through the control of water amount and particle size, so as to be suitable for filling into the smoke tube by injection. Compared with a traditional filament or sheet-shaped aerosol-generating article, the above-mentioned pasty HNB aerosol-generating article of the present invention is in the shape of paste. It is injected into the cartridge tube in the form of injection, and it is injected in a shape of stick, which is convenient to control the injection amount. Moreover, an injection hole is opposite to the smoke tube, the paste-like HNB aerosol-generating article can be injected quickly and swiftly, and the operation is simple and easy to control. In addition, the above-mentioned paste-like HNB aerosol-generating article of the present invention automatically forms pores after drying, and appears as a loose columnar body. When the user performs a suction action, the pores are convenient for the aerosol passing through the paste stick HNB aerosol-generating article into the human mouth smoothly, and the smoking experience is better.

The above-mentioned HNB aerosol-generating article has at least the following advantages.

1. Reasonable and uniform porosity of the aerosol-generating article, so that there is a certain suction resistance during the smoking process, which is closer to the suction resistance of cigarette smoking.

2. During the heating process, because the aerosol-generating article is one-piece, a heating piece is inserted into a heating body, and the heat generated by the heating piece is easily transferred to an entire aerosol-generating article, which makes the heat conduction more uniform and it is easier to obtain larger smoke. Thereby a better suction feeling is obtained.

3. Preferably, aerosol produced by heating without burning under the temperature condition of 200-300°, that is the aerosol produced by the evaporation of glycerin contained in the aerosol-generating article, and will not produce harmful tar. The Chinese medicine ingredients added in the aerosol-generating article are beneficial to health.

BRIEF DESCRIPTION OF THE DRAWINGS

FIG. 3-1 is a schematic structural diagram of a pneumatic injection device for an HNB aerosol-generating article and an aerosol-generating article according to an embodiment of the present invention.

FIG. 3-2 is a schematic structural diagram of a motor screw-driven injection device for an HNB aerosol-generating article and an aerosol-generating article according to an embodiment of the present invention.

DETAILED DESCRIPTION

The present invention will be described in detail below with reference to specific embodiments and accompanying drawings.

Figure 1:
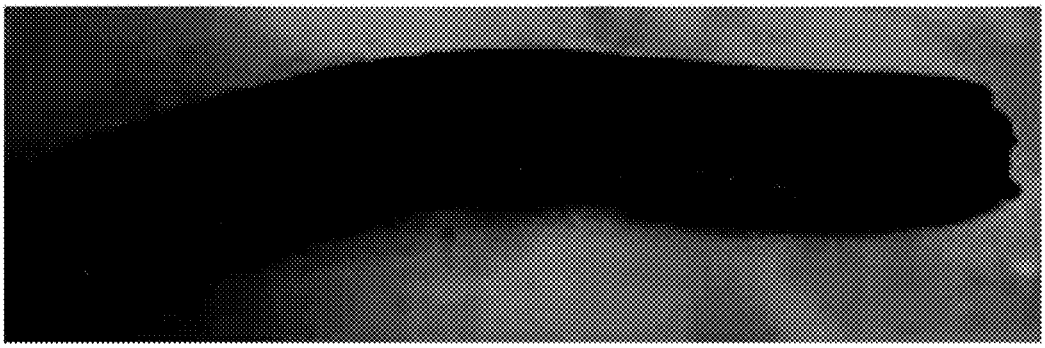
FIG. 1 is a solid schematic diagram of a heat-not-burn (HNB) aerosol-generating article according to an embodiment of the present invention.
Figure 2:
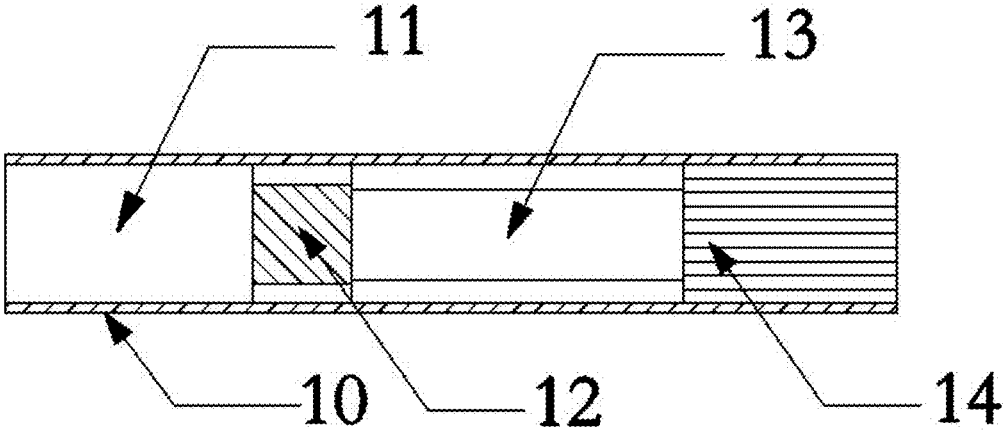
FIG. 2 is a schematic structural diagram of an HNB tube according to an embodiment of the present invention.

Referring to FIG. 1 and FIG. 2, which show a heat-not-burn (HNB) aerosol-generating article 100 according to an embodiment of the present invention, which is used to install a tube 10 of an HNB non-tobacco or tobacco products, including aerosol-generating raw material, aerosol-generating agent, and water. Wherein the aerosol-generating raw material is pre-pulverized and then sieved through a mesh sieve, preferably a 40-200 mesh sieve. The aerosol-generating raw material, the aerosol-generating agent, and the water are mixed and blended into paste, so that the HNB aerosol-generating article 100 is in a shape of paste stick when extruded, and is used to be injected into the HNB cartridge tube 10 by extrusion into the paste stick. Specifically, as shown in FIG. 1, the paste stick is a long paste shape, which can be arbitrarily curved, like a long mud shape, with unevenness or pores on the surface, and is generally smooth.

Preferably, a mass percentage of the water is 30%-60%. As shown in FIG. 1, under this humidity, the HNB aerosol-generating article 100 is in a form of a paste with a certain humidity. Moisture in this content range can make each component form an integral body like slime, which is easy to agglomerate, and the combination is relatively tight. After drying, it will volatilize water and form fine pores. The mass percentage of the water is more preferably 30%-60%. If the water is too few, it will not be easy to form a paste that can be extruded into long stick, and too much water is not conducive to molding.

Preferably, the HNB aerosol-generating article 100 includes the following parts by weight: 40-80 parts of aerosol-generating raw material, 30-60 parts of aerosol-generating agent, and 30-50 parts of water. More preferably, it is composed of the following parts by weight: 40-80 parts of aerosol-generating raw material, 40-60 parts of aerosol-generating agent, and 30-40 parts of water.

Preferably, the aerosol-generating agent contains 30-60 parts of glycerin. The aerosol-generating agent in the embodiment of the present invention is preferably edible glycerin, which is miscible with water, helps the HNB aerosol-generating article to be reconciled into a paste and has the effect of locking water. It preferably volatilizes when heated to 200° C. to 300° C. to produce a smokeable aerosol.

Preferably, the aerosol-generating raw material includes a combination of one or more of herbal spice or Chinese medicine raw material, the herbal spice is preferably a combination of one or more of tea, lotus leaf, mint, licorice, clove, dried lemon, dried orange, chrysanthemum, star anise, osmanthus, mulberry leaf, bay leaf, perilla, orange, angelica dahurica, amomum tsao-ko, tangerine peel, gynostemma pentaphyllum, lavender, hawthorn, rose, honeysuckle, tartary buckwheat tea, chestnut, ilibiscus, lily, lysimachia foenum-graecum hance, spikenard, abrus cantoniensis, banksia rose, sandalwood, agarwood, coffee, blueberry, and strawberry. The Chinese medicine raw material can be a combination of one or more of radix rehmanniae, prepared rehmannia root, angelica sinensis, cassia seed, dandelion, apocynum venetum, jujube, medlar, fritillaria cirrhosa, panax notoginseng, sterculia scaphigera, borneol, menthol, saffron, poria, pueraria, dalbergia odorifera, holy basil, perilla leaves, bupleurum, isatis root, astragalus, prunella vulgaris, ginseng, white peony, gastrodia elata, and schisandra chinensis, and the aerosol-generating raw material is made by grinding into powder and mixing.

Preferably, the aerosol-generating raw material includes tobacco raw material or tobacco extract, and the aerosol-generating raw material can be independently composed of tobacco raw material or tobacco extract. The aerosol-generating raw material can also be made from the tobacco raw material or the tobacco extract mixed with a combination of one or more of herbal spice and Chinese medicine raw material. When mixed with the herbal spice or the Chinese medicine raw material, the tobacco raw material is ground into powder first, and then the tobacco raw material powder is mixed into the herbal spice or Chinese medicine raw material and ground into powder and mixed together.

Preferably, a density of the paste stick HNB aerosol-generating article 100 is 0.5 g-1.5 g/ml, and a dynamic viscosity is 150-500 Pa.s. The dynamic viscosity is to ensure that the HNB aerosol-generating article 100 is in a shape of paste stick. The HNB aerosol-generating article 100 has pores inside to allow the aerosol to penetrate and exude. When heated, a porosity is 40-75%, and the paste stick HNB aerosol-generating article 100 having internal pores is preferably in form of a columnar paste, which automatically forms a loose columnar body after being heated.

Figures 1, 3:
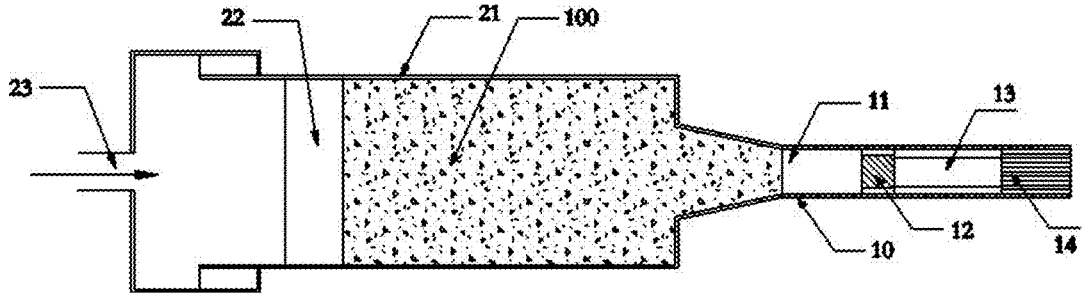
Figures 2, 3:
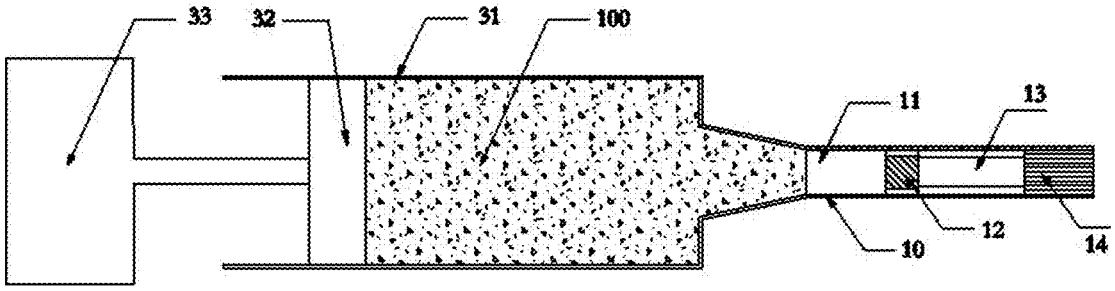
Figure 4:
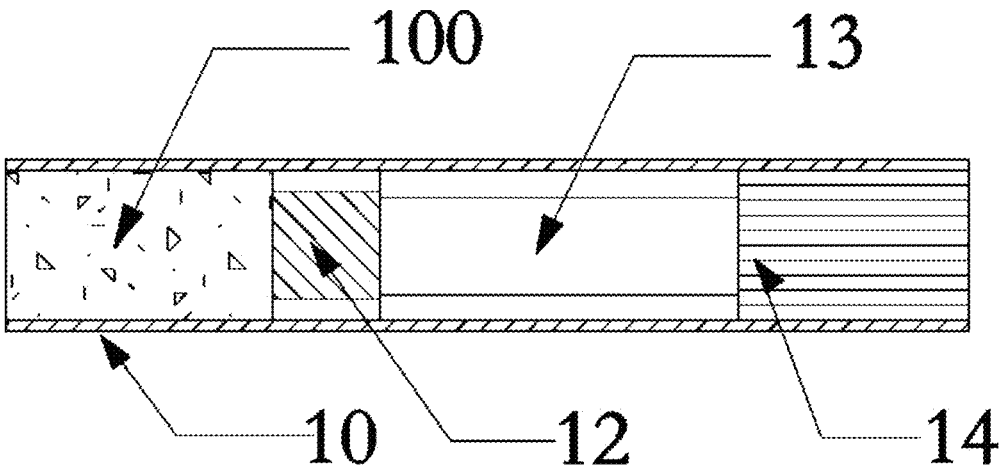
FIG. 4 is a structural diagram of an HNB aerosol-generating article after being injected into an HNB cartridge tube according to an embodiment of the present invention.

Referring to FIGS. 3 to 4 in conjunction with FIG. 1 and FIG. 2. When the paste stick HNB aerosol-generating article 100 is injected into the HNB cartridge tube 10, it is generally injected into the HNB cartridge tube 10 by means of air pressure, hydraulic pressure, or mechanical pressure. Then, the water is removed by drying, preferably by vacuum drying, baking or air drying, etc., to evaporate the water in the paste stick HNB aerosol-generating article 100, so that the water content is reduced to 5-10% by mass.

In another embodiment of the present invention, there is also provided an HNB tobacco product, which includes the HNB aerosol-generating article as described above. In the HNB tobacco product thereof, the aerosol-generating raw material is independently composed of tobacco raw material or tobacco extract, and the tobacco raw material or tobacco extract is ground into powder; it can also be made from the tobacco raw material or the tobacco extract mixed with a combination of one or more of herbal spice and Chinese medicine raw material, when mixed with the herbal spice or the Chinese medicine raw material, the tobacco raw material is ground into powder first, and then the tobacco raw material powder is mixed into the herbal spice or Chinese medicine raw material and ground into powder and mixed together.

In some embodiments, there is further provided an HNB tobacco product, which includes a cartridge tube 1 and the above-mentioned tobacco product aerosol-generating article 100 loaded into the cartridge tube 1, wherein the tobacco product is an HNB tobacco product. When the HNB tobacco product is inserted into a heater, the tobacco product aerosol-generating article 100 in the HNB tobacco product is heated to 200° C. to 350° C. by a heating sheet to generate aerosol that can be smoked. The present invention preferably generates aerosol that can be smoked when heated to 200° C. to 300° C., and the paste stick HNB aerosol-generating article 100 has pores inside, so that when the user performs a smoking action, the pores allow the aerosol to smoothly pass through the paste stick HNB aerosol-generating article 100, thereby reaching the user's mouth.

An embodiment of the present invention also provides an HNB non-tobacco product, which includes an HNB cartridge tube 10 and an HNB aerosol-generating article installed in the tube 10. The HNB non-tobacco product can generate smokeable aerosol when heated to 200° C. to 350° C. Preferably, it produces smokeable aerosol when heated to 200° C. to 300° C. in the present invention. The paste stick HNB aerosol-generating article 100 has pores inside. When the user performs a smoking action, the pores allow the aerosol to smoothly pass through the paste stick HNB aerosol-generating article 100, thereby reaching the user's mouth.

Preferably, the HNB cartridge tube 1 includes a tube 10, a paste-like aerosol-generating article charging chamber 11, a aerosol-generating article blocking plug 12 with a channel, an aerosol cooling body or other fillers 13, and an aerosol filter cotton 14, the paste-like aerosol-generating article charging chamber 11 is equipped with an HNB aerosol-generating article 100.

Preferably, as shown in FIG. 3-1, an air pressure method adopts a pneumatic injection device 2. The pneumatic injection device 2 includes an extrusion tube 21, a pneumatic push piston 22, and a pneumatic drive 23. The HNB aerosol-generating article 100 is installed in the extrusion tube 21.

Preferably, as shown in FIG. 3-2, a mechanical pressure method adopts a motor screw-driven injection device 3, and the motor screw-driven injection device 3 includes an extrusion tube 31, a motor pusher piston 32, and a motor screw drive 33. The HNB aerosol-generating article 100 is installed in the extrusion tube 31.

Furthermore, an embodiment of the present invention further provides a manufacturing method of the HNB aerosol-generating article 100, which includes the following steps: pulverizing the aerosol-generating raw material, and sieving through a 40-200 mesh sieve after pulverizing; mixing the aerosol-generating raw material and the aerosol-generating agent according to a proportion, and adding a predetermined amount of water to make the mixture into the paste, so as to facilitate a molding of the HNB aerosol-generating article 100 into paste stick.

The above-mentioned HNB aerosol-generating article 100 includes aerosol-generating raw material, aerosol-generating agent, and water. The aerosol-generating raw material is pre-pulverized and then sieved through a 40-200 mesh sieve. The aerosol-generating raw material, the aerosol-generating agent, and water are mixed with water and blended into paste, so that the HNB aerosol-generating article 100 is in a shape of a paste stick when extruded, and is used to be injected into the HNB cartridge tube 11 by extrusion into the paste stick. The paste stick HNB aerosol-generating article 100 having internal pores is preferably in a form of loose paste stick, which automatically forms a loose columnar body after being heated. When the user performs a suction action, the pores are convenient for the aerosol passing through the paste stick HNB aerosol-generating article. It is suitable for HNB non-tobacco products or HNB tobacco products and the like.

The following will illustrate the composition and efficacy of the HNB aerosol-generating article of the present invention, as well as the structure and efficacy of the product, through a number of embodiments.

First Embodiment

A composition of the HNB aerosol-generating article in the present embodiment is as follows:

1. 50 g tea, 20 g mint, 10 g lotus leaf,
2. glycerin 30 g, and
3. water 50 g.

Tea contains catechin, cholestene, caffeine, inositol, folic acid, pantothenic acid, and other ingredients, which can improve human health. Tea beverages—tea is known as "one of the three major beverages in the world".

Lotus leaves are rich in alkaloids, such as monobenzyl isoquinolines, dibenzyl isoquinolines, apophines and dehydroapophines, etc., as well as flavonoids and β-sitosterol, carotene, organic acids, β-sitosterol-3-0-β-D-glucopyranoside, isophytol, trans-phytol, 7,11,15-trimethyl-2-hexadecanone, 10-eicosanol, 24(R)-ethylcholest-6-ene-5a-ol-3-O-β-D-glucopyranoside, lotus leaf polysaccharide fatty acid, protein, and other ingredients such as trace elements.

With tea and mint as the main ingredients and lotus leaf as the auxiliary ingredient, the raw material formula of the aerosol-generating article can obtain the aerosol with the fragrance of tea and lotus leaf, and the cool flavor of mint.

Mint is a perspiration and antipyretic medicine, which can cure influenza, headache, red eyes, body heat, sore throat, and gum swelling and pain, etc. It also has the effect of clearing the mind and brightening the eyes.

Glycerin is edible glycerin, which can generate aerosol when heated to 200-300°, and acts as a aerosol-generating agent in the aerosol-generating article.

The water plays the role of making the powder raw material into a paste, which can be easily added to the HNB cartridge tube by extrusion. Meanwhile, the pores are formed inside the aerosol-generating article after the moisture in the aerosol-generating article is evaporated, so that the aerosol-generating article maintains a certain porosity.

Second Embodiment 1. cassia seed 50 g, prunella vulgaris 50 g, chrysanthemum 30 g,
2. glycerin 30 g, and
3. water 70 g.

Cassia seed is bitter, sweet, salty, slightly cold in nature, enters the liver, kidney, and large intestine meridian; moistens the bowels, reduces lipids, improves eyesight, and treats constipation, hyperlipidemia, and hypertension. Clears the liver and improves eyesight, diuresis and laxative, has laxative effect, lowers blood pressure and lowers blood lipids.

Prunella vulgaris contains triterpenoid saponins, rutin, hypericin and other glycosides, and organic acids such as ursolic acid, caffeic acid, free zidonia acid. Its flower spikes contain delphinidin, cyanidin anthocyanins, d-camphor, d-fenisone, etc. It has the effect of clearing heat and improving eyesight, and can cure red eyes, swelling and pain, headache, etc.

Chrysanthemum has the functions of dispelling wind and calming the liver, smelling it, and having an auxiliary therapeutic effect on colds and headaches.

With cassia seed and prunella vulgaris as the main raw materials of the aerosol-generating article, chrysanthemum as the auxiliary material, and as a flavoring formula of smoke aroma, it can obtain unique smoke.

Glycerin is edible glycerin, which can generate aerosol when heated to 200-300°, and acts as an aerosol-generating agent in the aerosol-generating article.

The water plays the role of making the powder raw material into a paste, which can be easily added to the HNB cartridge tube by extrusion. Meanwhile, the pores are formed inside the aerosol-generating article after the moisture in the aerosol-generating article is evaporated, so that the aerosol-generating article maintains a certain porosity.

Third Embodiment 1. 50 g tea, 15 g tobacco leaves, 10 g mint,
2. glycerin 25 g, and
3. water 40 g.

Tea contains catechin, cholestene, caffeine, inositol, folic acid, pantothenic acid and other ingredients, which can improve human health. Tea beverages—tea is known as "one of the three major beverages in the world".

Mint is a perspiration and antipyretic medicine, which can cure influenza, headache, red eyes, body heat, sore throat, and gum swelling and pain, etc. It also has the effect of clearing the mind and brightening the eyes.

Tobacco leaves as the main source of nicotine, tobacco leaves mainly provide nicotine components in the aerosol-generating article. By heating the aerosol-generating article, the nicotine components in the tobacco leaves are brought into the aerosol, so that smokers can obtain the satisfaction of smoking nicotine components.

Tea is used as a carrier of the aerosol-generating article, a proportion of its components is different, so the concentration of tobacco leaves is also different, thus, a content of nicotine concentration in the aerosol-generating article can be adjusted.

Glycerin is edible glycerin, which can generate aerosol when heated to 200-300°, and acts as an aerosol-generating agent in the aerosol-generating article.

The water plays the role of making the powder raw material into a paste, which can be easily added to the HNB cartridge tube by extrusion. Meanwhile, the pores are formed inside the aerosol-generating article after the moisture in the aerosol-generating article is evaporated, so that the aerosol-generating article maintains a certain porosity.

Fourth Embodiment 1. 30 g lotus leaf, 10 g mint, 30 g coffee, 0.5 g menthol,
2. glycerin 30 g, and
3. water 35 g.

Lotus leaves are rich in alkaloids, such as monobenzyl isoquinolines, dibenzyl isoquinolines, apophines and dehydroapophines, etc., as well as flavonoids and β-sitosterol, carotene, organic acids, β-sitosterol-3-0-β-D-glucopyranoside, isophytol, trans-phytol, 7,11,15-trimethyl-2-hexadecanone, 10-eicosanol, 24(R)-ethylcholest-6-ene-5a-ol-3-O-β-D-glucopyranoside, lotus leaf polysaccharide fatty acid, protein, and other ingredients such as trace elements.

Coffee/coffee beans contain about 100 different substances, including caffeine, tannins, oils, and nitrogen compounds, etc., per 100 grams of instant coffee, containing 44-100 mg of caffeine; per 100 grams of brewed coffee, containing caffeine 64-124 mg, and it has the functions of refreshing, refreshing, strengthening stomach, strengthening body, and hemostasis.

Mint is a perspiration and antipyretic medicine, which can cure influenza, headache, red eyes, body heat, sore throat, and gum swelling and pain, etc. It also has the effect of clearing the mind and brightening the eyes.

Menthol has a cool, fresh, pleasant mint characteristic aroma with a sweet thorn. It gives a cold feeling and the fragrance penetrates the hair, but it is not long-lasting. The taste is also fresh and sweet.

Glycerin is edible glycerin, which can generate aerosol when heated to 200-300°, and acts as an aerosol-generating agent in the aerosol-generating article.

The water plays the role of making the powder raw material into a paste, which can be easily added to the HNB cartridge tube by extrusion. Meanwhile, the pores are formed inside the aerosol-generating article after the moisture in the aerosol-generating article is evaporated, so that the aerosol-generating article maintains a certain porosity.

Fifth Embodiment 1. gynostemma pentaphyllum 50 g, chrysanthemum 10 g, honeysuckle 5 g, menthol 0.2 g, borneol 0.1 g,
2. glycerin 25 g, and
3. water 40 g.

In addition to sterols, sugars, and pigments, gynostemma pentaphyllum contains more than 50 kinds of saponins, including tetracyclic triterpenoids, wherein four types of gypenoside III, IV, VII, and XII are the same substances as ginsenosides Rb1, Rb3, Rd, and F2, respectively. Rd is 8 times that of ginseng, a selenium-rich plant without sex hormones. Gynostemma pentaphyllum is used as the main ingredient for fuming, and the smoke generated by heating contains ingredients that promote and balance fat metabolism in the human body, so as to reduce blood lipids and reverse fatty liver and other nourishing effects. At the same time, it has exact effects on weight loss, laxative, detoxification, and sleep promotion.

Chrysanthemum can be used as medicine to treat diseases, long-term use or drinking chrysanthemum tea can make people live longer.

Honeysuckle has been known as a good medicine for clearing away heat and detoxifying since ancient times. It is sweet and fragrant in nature, sweet and cold and clears heat without hurting the stomach, and the fragrance is transparent and can dispel pathogens. Honeysuckle can not only dispel wind-heat, but also clear and detoxify blood.

Borneol is acrid, bitter, and slightly cold; it returns to the heart, liver, and lung meridians; it is fragrant and dissipated, which has the effect of opening the body and awakening the mind, clearing heat and dispelling toxins, improving eyesight and relieving nebula.

Menthol has a cool, fresh, pleasant mint characteristic aroma with a sweet thorn. It gives a cold feeling and the fragrance penetrates the hair, but it is not long-lasting. The taste is also fresh and sweet.

The smoke produced by the aerosol-generating raw material that processed from the above raw materials has a slightly sweet taste of gynostemma pentaphyllum, and also has the scent of chrysanthemum. Menthol and borneol can make the smoke have a refreshing effect.

Glycerin is edible glycerin, which can generate aerosol when heated to 200-300°, and acts as an aerosol-generating agent in the aerosol-generating article.

The water plays the role of making the powder raw material into a paste, which can be easily added to the HNB cartridge tube by extrusion. Meanwhile, the pores are formed inside the aerosol-generating article after the moisture in the aerosol-generating article is evaporated, so that the aerosol-generating article maintains a certain porosity.

After the HNB aerosol-generating article made according to the manufacturing method is injected into the smoke tube, heated to 200-300 degrees, and after the suction test is carried out, it is found that the effect is good.

1. Good cigarette suction resistance can be obtained. A suction resistance of the HNB non-tobacco or tobacco product of the present invention ranges 0.75-1.5 Kpa, which is basically the same as the suction resistance of a traditional lit cigarette, so as to obtain a good suction effect.

2. This HNB non-tobacco or tobacco product of the present invention is smoked by heating at 200-300°, during heating at 200-300°, the herbal material, Chinese medicine, or tobacco material will not decompose and is beneficial to physical and mental health. No harmful substances such as tar are produced during the heating process.

3. The aerosol-generating article is one-piece. During the heating process, a heating piece is inserted into a heating body, and the heat generated by the heating piece is easily transferred to an entire aerosol-generating article, which makes the heat conduction more uniform and it is easier to obtain larger smoke. Thereby a better suction feeling is obtained.

It should be noted that the present invention is not limited to the above-mentioned embodiments. According to the inventive spirit of the present invention, those skilled in the art can also make other changes. These modifications made according to the inventive spirit of the present invention should be included within the claimed scope of the present invention.

What is claimed is:

1. A heat-not-burn (HNB) aerosol-generating article used to be loaded into a tube of an HNB non-tobacco or tobacco products, wherein the HNB aerosol-generating article comprises:

aerosol-generating raw material, aerosol-generating agent, and water, wherein the aerosol-generating raw material is pre-pulverized and then sieved, a mass percentage of the water is 30%-60%, the aerosol-generating raw material, the aerosol-generating agent, and the water are mixed and blended into paste, so that the HNB aerosol-generating article is in a shape of paste stick with a density of 0.5 g-1.5 g/ml and a dynamic viscosity of 150-500 Pa.s when extruded, and is used to be injected into the tube of the HNB non-tobacco or tobacco products by extrusion into the paste stick;

wherein the paste stick HNB aerosol-generating article has internal pores to allow aerosol to penetrate and exude, a porosity thereof is 40-75%, and the paste stick HNB aerosol-generating article having internal pores is a columnar paste, which automatically forms a loose columnar body after being heated.

2. The HNB aerosol-generating article of claim 1, wherein the HNB aerosol-generating article is composed of following parts by weight: 40-80 parts of the aerosol-generating raw material, 30-60 parts of the aerosol-generating agent, and 30-50 parts of the water.

3. The HNB aerosol-generating article of claim 2, wherein the aerosol-generating agent is 30-60 parts of glycerol, and the aerosol-generating raw material is pre-pulverized and then sieved through a 40-200 mesh sieve.

4. The HNB aerosol-generating article of claim 3, wherein the aerosol-generating raw material comprises a combination of one or more of herbal spice or Chinese medicine raw material, the herbal spice is a combination of one or more of tea, lotus leaf, mint, licorice, clove, dried lemon, dried orange, chrysanthemum, star anise, osmanthus, mulberry leaf, bay leaf, perilla, orange, angelica dahurica, amomum tsao-ko, tangerine peel, gynostemma pentaphyllum, lavender, hawthorn, rose, honeysuckle, tartary buckwheat tea, chestnut, ilibiscus, lily, lysimachia foenum-graecum hance, spikenard, abrus cantoniensis, banksia rose, sandalwood, agarwood, coffee, blueberry, and strawberry, the Chinese medicine raw material can be a combination of one or more of radix rehmanniae, prepared rehmannia root, angelica sinensis, cassia seed, dandelion, apocynum venetum, jujube, medlar, fritillaria cirrhosa, panax notoginseng, sterculia scaphigera, borneol, menthol, saffron, poria, pueraria, dalbergia odorifera, holy basil, perilla leaves, bupleurum, isatis root, astragalus, prunella vulgaris, ginseng, white peony, gastrodia elata, and schisandra chinensis, and the aerosol-generating raw material is made by grinding into powder and mixing.

5. The HNB aerosol-generating article of claim 1, wherein the paste stick HNB aerosol-generating article is dried to remove moisture after being injected into an HNB cartridge tube, a moisture content is reduced to 5-10% by mass, and the paste stick HNB aerosol-generating article is injected into the HNB cartridge tube by means of pneumatic, hydraulic, or mechanical screw drive injection.

6. The HNB aerosol-generating article of claim 3, wherein the aerosol-generating raw material is composed of tobacco raw material or tobacco extract, the aerosol-generating raw material can also be made from the tobacco raw material or the tobacco extract mixed with a combination of one or more of herbal spice and Chinese medicine raw material, when mixed with the herbal spice or the Chinese medicine raw material, the tobacco raw material is ground into powder first, and then the tobacco raw material powder is mixed into the herbal spice or Chinese medicine raw material and ground into powder and mixed together.

7. An HNB product, comprising a cartridge tube and the HNB aerosol-generating article of claim 1 loaded into the cartridge tube.

8. The HNB product of claim 7, wherein the aerosol-generating article comprises tobacco raw material or tobacco extract.

9. A manufacturing method of the HNB aerosol-generating article of claim 1, wherein the manufacturing method comprises steps of:

pulverizing the aerosol-generating raw material, wherein a pulverized particle size is 40-200 mesh, mixing the aerosol-generating raw material and the aerosol-generating agent according to a proportion, and adding a predetermined amount of water to make the mixture into the paste.

* * * * *